US005589926A

United States Patent [19]

Murasawa et al.

[11] Patent Number: 5,589,926

[45] Date of Patent: Dec. 31, 1996

[54] COLOR IMAGE FORMING APPARATUS FOR FORMING A COLOR IMAGE BY TRANSFERRING COLOR TONER TO TRANSFER MEMBER

[75] Inventors: Yoshihiro Murasawa, Yokohama; Hisashi Fukushima, Kawasaki; Takeshi Menjo, Tokyo; Takashi Hasegawa, Ageo, all of Japan

[73] Assignee: Canon Kabushiki Kaisha, Tokyo, Japan

[21] Appl. No.: 538,037

[22] Filed: Oct. 2, 1995

Related U.S. Application Data

[63] Continuation of Ser. No. 503,540, Jul. 18, 1995, abandoned, which is a continuation of Ser. No. 213,501, Mar. 16, 1994, abandoned.

[30] Foreign Application Priority Data

Mar. 19, 1993 [JP] Japan ..... 5-083783

[51] Int. Cl.[6] ..... G03G 15/00

[52] U.S. Cl. ..... 399/302; 399/225

[58] Field of Search ..... 355/271, 272, 355/274, 311, 326 R, 327, 245

[56] References Cited

U.S. PATENT DOCUMENTS 4,712,906 12/1987 Bothner et al. ..... 355/271
5,121,163 6/1992 Muramatsu et al. ..... 355/246
5,249,024 9/1993 Menjo ..... 355/271 X
5,294,959 3/1994 Nagao et al. ..... 355/208
5,327,209 7/1994 Sasanuma et al. ..... 355/327

*Primary Examiner*—Joan H. Pendegrass
*Attorney, Agent, or Firm*—Fitzpatrick, Cella, Harper & Scinto

[57] ABSTRACT

An apparatus for forming color toner images on an electrophotographic photosensitive drum and transferring the color toner images onto a transfer drum, is provided with plural color development devices positioned along the rotating direction of the photosensitive drum and opposed thereto, and the above-mentioned transfer drum of a peripheral length is capable, in the rotating direction of the photosensitive drum, of simultaneously supporting two images of a maximum length L to be formed, wherein a relation:

$$d_p=(2\pi R-2L)/2>d_s\geqq 2r+(V_p/V_s)\pi r$$

is substantially satisfied among the peripheral length A of the transfer drum, radius R and peripheral speed $V_p$ of the transfer drum, radius r and peripheral speed $V_s$ of the developing rollers of the development means, distance $d_p$ of two images on the transfer drum, and distance $d_s$ of the developing rollers in the rotating direction of the photosensitive drum.

15 Claims, 4 Drawing Sheets

COLOR IMAGE FORMING APPARATUS FOR FORMING A COLOR IMAGE BY TRANSFERRING COLOR TONER TO TRANSFER MEMBER

This application is a continuation of application Ser. No. 08/503,540 filed Jul. 18, 1995, which is a continuation of application Ser. No. 08/213,501 filed Mar. 16, 1994, both now abandoned.

BACKGROUND OF THE INVENTION

1. Field of the Invention

The present invention relates to an image forming apparatus provided with plural color developing units positioned opposite to an electrophotographic photosensitive member, and adapted to transfer images, composed of developing agents and formed in succession by said developing units on the photosensitive member, onto a transfer member.

2. Related Background Art

FIG. 4 illustrates a conventional electrophotographic color image forming apparatus for forming a full-color image, in which a photosensitive drum 1 serving as the photosensitive member is supported rotatably in a direction R1, and a charging device 2, an optical system 3, a developing device 5, a transfer device 6 and a cleaning device 7 are positioned around said photosensitive drum 1.

The optical system 3 is composed of a laser beam exposure device, provided with an original scanning unit and color separation filters and adapted to irradiate the photosensitive drum 1 with a color-separated light image E or a light image corresponding thereto. The photosensitive drum 1, uniformly charged by the charging device 2, is subjected to scanning irradiation of the light image E for each separated color, thereby forming an electrostatic latent image. The developing device 5 is constructed as a rotatable developing device composed of a rotary member 5*a* having a center of rotation at a central shaft 5*b*, and four color developing devices, i.e., a yellow developing device 5Y, a magenta developing device 5M, a cyan developing device 5C and a black developing device 5BK, and is adapted to move, by rotation, a desired developing device to a developing position opposed to the photosensitive drum 1 and to effect reversal development of the electrostatic latent image on the photosensitive drum 1, thereby forming a toner image composed of electrophotographic color toner on said photosensitive drum 1.

The toner image on the photosensitive drum 1 is then transferred onto a recording material P by the transfer device 6, which is provided with a transfer charger 6*b*, an attraction corona charger 6*c* for electrostatically attracting the recording material P, an attraction roller 6*g* positioned opposite thereto, an internal corona charger 6*d* and an external corona charger 6*e*, and, on a peripheral aperture of a rotatably supported transfer drum 6*a*, a recording material support sheet 6*f*, consisting of a dielectric material, is integrally extended in cylindrical form. The recording material P is supplied to the transfer device 6 from a cassette 9 through a transport system.

With the rotation of the transfer drum 6*a* in a direction R6, the toner image on the photosensitive drum 1 is electrostatically transferred, by a polarity of the transfer charger 6*b* opposite to the polarity of uniform charging of the photosensitive drum 1, onto the recording material P supported on the support sheet 6*f*. Thus, color images of a desired number are transferred in succession onto the recording material P supported by attraction on the support sheet 6*f*, thereby forming a full-color image.

After transfer of the desired number of toner images, the recording material P is separated from the transfer drum by a separating charger 6*h* and separation means 10, then is subjected to fixation of the toner images by a fixing device 11 provided with heated rollers, and is then discharged onto a sheet discharge tray 12.

On the other hand, after the toner image transfer, the photosensitive drum 1 is subjected to a cleaning operation where toner remaining on the surface is cleaned off by cleaning device 7, and is subjected again to an image forming process.

However, the above-explained conventional technology has been associated with the following drawbacks. As the polarity of toner charging is opposite to that of uniform charging of the photosensitive drum 1 (for example the photosensitive drum 1 is charged negatively while the transfer charging is charged positively), the charge of the transfer charging induces a transfer memory on the photosensitive drum 1 through the recording material support sheet 6*f* and the recording material P, whereby uniform charging of the photosensitive drum in the next image forming process may become uneven and, in case of reversal development, the final image density may become uneven.

Particularly when the photosensitive drum 1 is small in radius so that the peripheral length thereof is shorter than the maximum length of the recording material, uniform charging in the first turn of the photosensitive drum 1 is not affected by the image transfer but uniform charging in the second and subsequent turns is influenced by the transfer memory effect, thereby generating so-called density step, namely a phenomenon of a higher density in the image formed in such second and subsequent turns. Such transfer memory effect is particularly conspicuous when an organic photoconductor, advantageous in safety and cost, is employed on the photosensitive drum 1.

As a countermeasure for such phenomenon, there has been conceived an apparatus provided with an additional charger for effecting a charging step after the image transfer and prior to the uniform charging, in order to eliminate the transfer memory, but the influence of image transfer may still appear as a step difference in density, as it is difficult to eliminate such influence of transfer, following the variations for example in the moisture absorbing characteristics of the recording material P, in the electrostatic capacitance of the photosensitive member, etc.

Also in the conventional technology explained above, the developing device 5 of the rotary type effects reversal development of the electrostatic latent image on the photosensitive drum 1, by rotating the developing device of a desired color to the developing position opposed to said photosensitive drum. For this reason it is necessary to secure a time required for the rotational mechanical movement, and, in an image forming mode supporting plural recording materials P on the transfer drum 6*a*, the developing devices cannot be exchanged within the time between the recording materials. The transfer drum 6*a* has to be rotated unnecessarily in order to secure such exchanging time, so that the overall copying speed is inevitably lowered significantly.

SUMMARY OF THE INVENTION

An object of the present invention is to resolve the above-mentioned drawbacks in the prior art and to provide a color image forming apparatus with improved efficiency of image formation.

Another object of the present invention is to reduce the operations of the image forming apparatus to a minimum necessary level, thereby improving the durability of the entire apparatus.

The above-mentioned objects can be attained, according to the present invention, by a color image forming apparatus for obtaining a color image by transferring color toners to a transfer material, comprising an electrophotographic photosensitive member effecting endless movement, color latent image forming means provided with optical means for projecting optical information corresponding to color images, in order to form electrostatic latent images corresponding to respective color images on said photosensitive member, plural color development means provided along the moving direction of said photosensitive member and opposite thereto, and adapted to develop said latent images by the supply of color toners with developing rollers, thereby forming color toner images, and a transfer member effecting endless movement in synchronization with the electrophotographic photosensitive member and having a length, in the moving direction of the photosensitive member, capable of supporting simultaneously two images of a largest length L to be formed, and adapted to receive color toner images formed on said photosensitive member in succession at a transfer position of said transfer member, wherein a relation:

$$d_p=(2\pi R-2L)/2>d_s\geqq 2r+(V_p/V_s)\pi r$$

in which A is the peripheral length of said transfer member in the moving direction, R and $V_p$ are the radius and the peripheral speed when the transfer member is assumed as circular, r and $V_s$ are the radius and the peripheral speed of the developing roller of the above-mentioned developing means, $d_p$ is the distance between two images on the transfer member, and $d_s$ is the distance of the developing rollers along the moving direction of the photosensitive member.

DETAILED DESCRIPTION OF THE PREFERRED EMBODIMENTS

Now the present invention will be clarified in detail by preferred embodiments thereof to be explained in the following with reference to the attached drawings.

[Embodiment 1]

Figure 1:
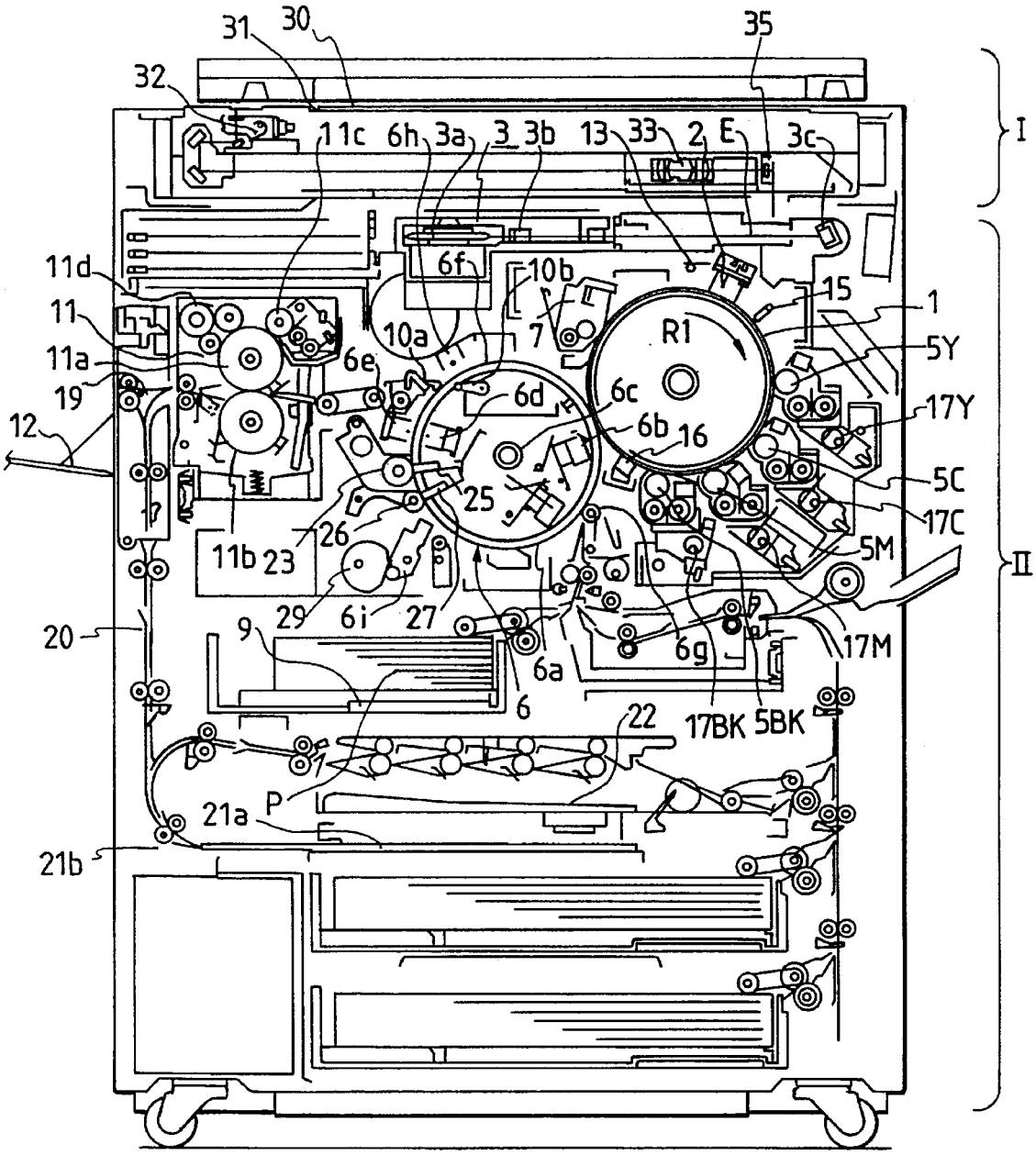
FIG. 1 is a longitudinal cross-sectional view of an image forming apparatus of the present invention.

The configuration and function of the image forming apparatus of the present invention will be briefly explained with reference to FIG. 1. The apparatus is a digital four-color image forming apparatus employing an electrophotographic process, and is composed of a reader unit I positioned above and a printer unit II positioned below.

The reader unit I reads the image information of an original 30 and sends the image information to the printer unit II. At the top of the reader unit I, there is provided a transparent original supporting glass 31, on which is placed an original 30 to be read, with the image bearing face thereof downwards. Below the original supporting glass 31 there is provided an exposure lamp 32 capable of reciprocating motion. The exposure lamp 32 scans the entire image bearing face of the original 30, by illuminating the lateral width (perpendicular to the plane of FIG. 1) and moving in the front-rear direction (horizontal direction in FIG. 1). The illuminating light, reflected by the image bearing face, is transmitted through mirrors, a lens 33, etc. and is condensed on a full-color sensor 35, thereby generating color-separated image signals, which are transmitted through an unrepresented amplifying circuit, then processed in a video processing unit and sent to the printer unit II.

The printer unit II is provided with a photosensitive drum 1, serving as an electrophotographic photosensitive member. The photosensitive drum 1 employs an organic photoconductor as will be explained later, and is supported rotatably in a direction R1, in the main body of the printer unit. Around the photosensitive drum 1 there are provided, in the following order along the rotating direction, a pre-exposure lamp 13, a corona charger 2, a laser exposure optical system 3, a potential sensor 15, four color developing devices 5Y, 5C, 5M, 5BK of different colors, light amount detection means 16 for detecting the light amount on the photosensitive drum 1, a transfer device 6 and a cleaning device 7. In the laser exposure optical system, the image signals from the reader unit I are converted in a laser unit (not shown) into a laser beam, which is reflected by a polygon mirror 3*a* and is projected through a lens 3*b* and a mirror 3*c* onto the photosensitive drum 1.

The image formation in the printer unit II is conducted by rotating the photosensitive drum 1 in a direction R1, charging uniformly and negatively the photosensitive drum 1 by the charger 2, after charge elimination by the pre-exposure lamp 13, and projecting a light image E for each separated color, thereby forming an electrostatic latent image. The negatively charged surface of the photosensitive drum 1 loses the charge to an almost zero potential in the area exposed to the light image E, and said area constitutes an electrostatic latent image corresponding to the original image.

Then a developing device corresponding to each separated color is activated to effect reversal development of the electrostatic latent image on the photosensitive drum 1, with toner of the same polarity (negative) as the latent image, thereby forming, on the photosensitive drum 1, a toner image (developer image) with color toner principally composed of a resinous material. The developing devices 5Y, 5C, 5M, 5BK are selectively brought close to the photosensitive drum 1, according to the separated color, by the function of eccentric cams 17Y, 17C, 17M, 17BK.

Then the toner image on the photosensitive drum 1 is transferred onto a recording material P, which is transported to a position opposed to the photosensitive drum 1, from a cassette 9 through a transport system and a transfer device (recording material supporting member) 6. The transfer device 6 is provided with a transfer drum 6*a* of a peripheral length corresponding to the maximum length of the recording material, a transfer charger 6*b*, an attraction charger 6*c* for electrostatically attracting the recording material P, an attraction roller 6*g* opposed thereto, an internal charger 6*d* and an external charger 6*e*, and, on a peripheral aperture of the rotatably supported transfer drum 6*a*, a recording material support sheet 6f is integrally extended in cylindrical form. Said support sheet 6f is composed of a dielectric sheet such as polycarbonate film.

With the rotation of the transfer drum 6a, the toner image on the photosensitive drum 1 is transferred, by the function of the transfer charger 6b, onto the recording material P supported on the recording material support sheet 6f.

In this manner color images of a desired number are transferred onto the recording material P supported by attraction on the support sheet 6f, thereby forming a full-color image. In case of such full-color image formation, after the transfers of four color toner images, the recording material P is separated from the transfer drum 6a by the function of a separating finger 10a, a separating push-up roller 10b and a separating charger 6h, then subjected to fixation of the toner images in a fixing device 11 provided with a fixing roller 11a, a pressure roller 11b, a releasing roller 11c and a cleaning roller 11d, and is subsequently discharged onto a sheet discharge tray 12.

On the other hand, after the toner image transfer, the photosensitive drum is cleaned by the removal of remaining toner by the cleaning device 7, and is subsequently used again in the image forming process.

In case of forming images on both faces of the recording material P, it is guided to a transport path switching guide 19, after being discharged from the fixing device 11, then is guided through a vertical path 20 into an inversion path 21a, then is discharged therefrom by reversing an inversion roller 21b, in the opposite direction with the trailing end at the entry as the leading end, and is stored in an intermediate tray 22. Thereafter an image is formed on the other face, by the above-explained image forming process.

In order to prevent powder scattering onto the recording material support sheet 6f of the transfer drum 6a and oil deposition onto the recording material P, a cleaning operation is conducted by a fur brush 23 and a back-up brush 25 positioned mutually opposite across the support sheet 6f and by an oil removing roller 26 and a back-up brush 27 similarly positioned mutually opposite across said support sheet 6f. Such cleaning is conducted before or after image formation, and also at any time in the case of sheet jamming.

In this embodiment, an eccentric cam 29 can be driven at a desired timing to activate a cam follower 6i integral with the transfer drum 6a, thereby arbitrarily regulating the gap between the recording material support sheet 6f and the photosensitive drum 1. For example, the transfer drum 6a and the photosensitive drum 1 are mutually separated during a stand-by state or when the power supply is turned off.

In this embodiment, a preferable image forming apparatus could be constructed by employing an organic photoconductor of the following structure as the photosensitive drum 1. While the organic photoconductor has the advantages of inexpensiveness and safety, it may be susceptible, depending on the film strength, to repeated contacts in a same portion with a projecting part of the transfer drum 6a, and also to repeated damage for example by descent of $NO_x$ from the corona charger 2 in a part of the photosensitive drum 1 positioned therebelow when said drum 1 is stopped. For avoiding such drawbacks, the mutual engagement of the transfer drum 6a and the photosensitive drum 1 is preferably adjusted so that the stopped position of the photosensitive drum is progressively shifted.

In the following example there will be explained the method of preparation of the photosensitive member according to the present invention.

50 parts by weight of conductive powdered titanium oxide, coated with tin oxide containing antimony oxide in 10% amount, 25 parts by weight of phenolic resin, 20 parts by weight of methyl cellosolve, 5 parts by weight of methanol and 0.002 parts by weight of silicone oil (polydimethylsiloxane-polyoxyalkylene copolymer, number-averaged molecular weight: 3000) were dispersed for 2 hours in a sand mill employing glass beads of 1 mm in diameter to obtain conductive paint. An aluminum cylinder (diameter 80 mm×length 360 mm) was dip coated with the above-mentioned paint and dried at 140° C. for 30 minutes to form a conductive layer having a thickness of 20 μm.

Then a solution, obtained by dissolving 30 parts by weight of methoxymethylated nylon resin (number-averaged molecular weight: 32,000) and 10 parts by weight of alcohol-soluble copolymerized nylon resin (number-averaged molecular weight 29,000) in mixed solvent consisting of 260 parts by weight of methanol and 40 parts by weight of butanol, was dip coated on the above-mentioned conductive layer to form a subbing layer of a dried thickness of 1 μm.

Separately 4 parts by weight of a disazo pigment of the following formula:

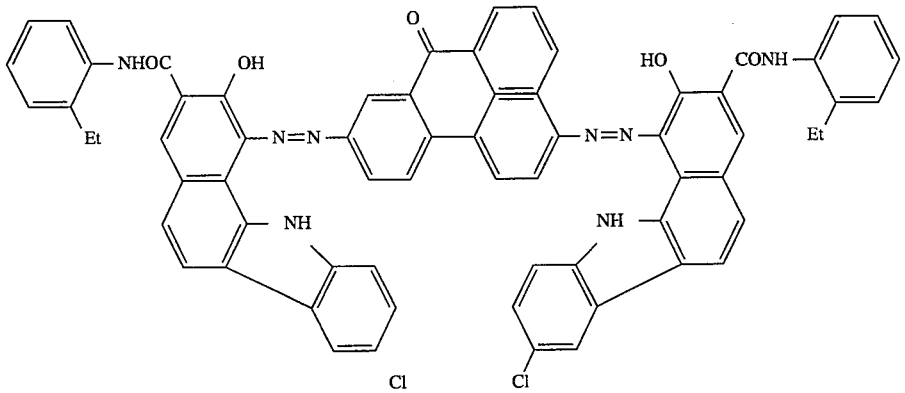

2 parts by weight of benzal resin and 40 parts by weight of tetrahydrofurane were dispersed for 60 hours in a sand mill employing glass beads of 1 mm in diameter, and were then diluted with a mixture of cyclohexanone and tetrahydrofurane to obtain paint for the charge generating layer.

This paint was dip coated on the above-mentioned subbing layer to form a charge generating layer of a dried thickness of 0.1 μm.

Separately a solution obtained by dissolving 10 parts by weight of a charge transfer material of the following formula:

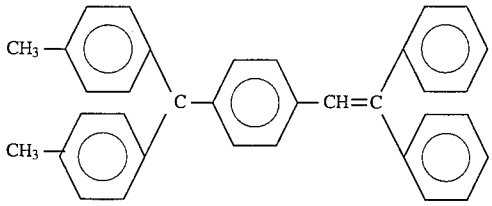

and 10 parts by weight of polycarbonate resin (number-averaged molecular weight: 25,000) in a mixture of 20 parts by weight of dichrolomethane and 40 parts by weight of monochlorobenzene, was dip coated on the above-mentioned charge generating layer and dried at 120° C. for 60 minutes to form a charge transfer layer of a thickness of 20 μm.

Separately 4 parts by weight of acrylic monomer resin, 5 parts by weight of tin oxide (average primary particle size: 0.3 μm) and 1 part by weight of a photopolymerization initiator were dispersed and dissolved in 30 parts by weight of ethanol, and the obtained liquid was dip coated on the above-mentioned charge transfer layer and was irradiated with a metal halide lamp (illumination intensity: 560 $mW/cm^2$, measured with a sensor having the central sensitivity at 360 nm) to form a surfacial protective layer of a thickness of 3 μm.

Figure 2:
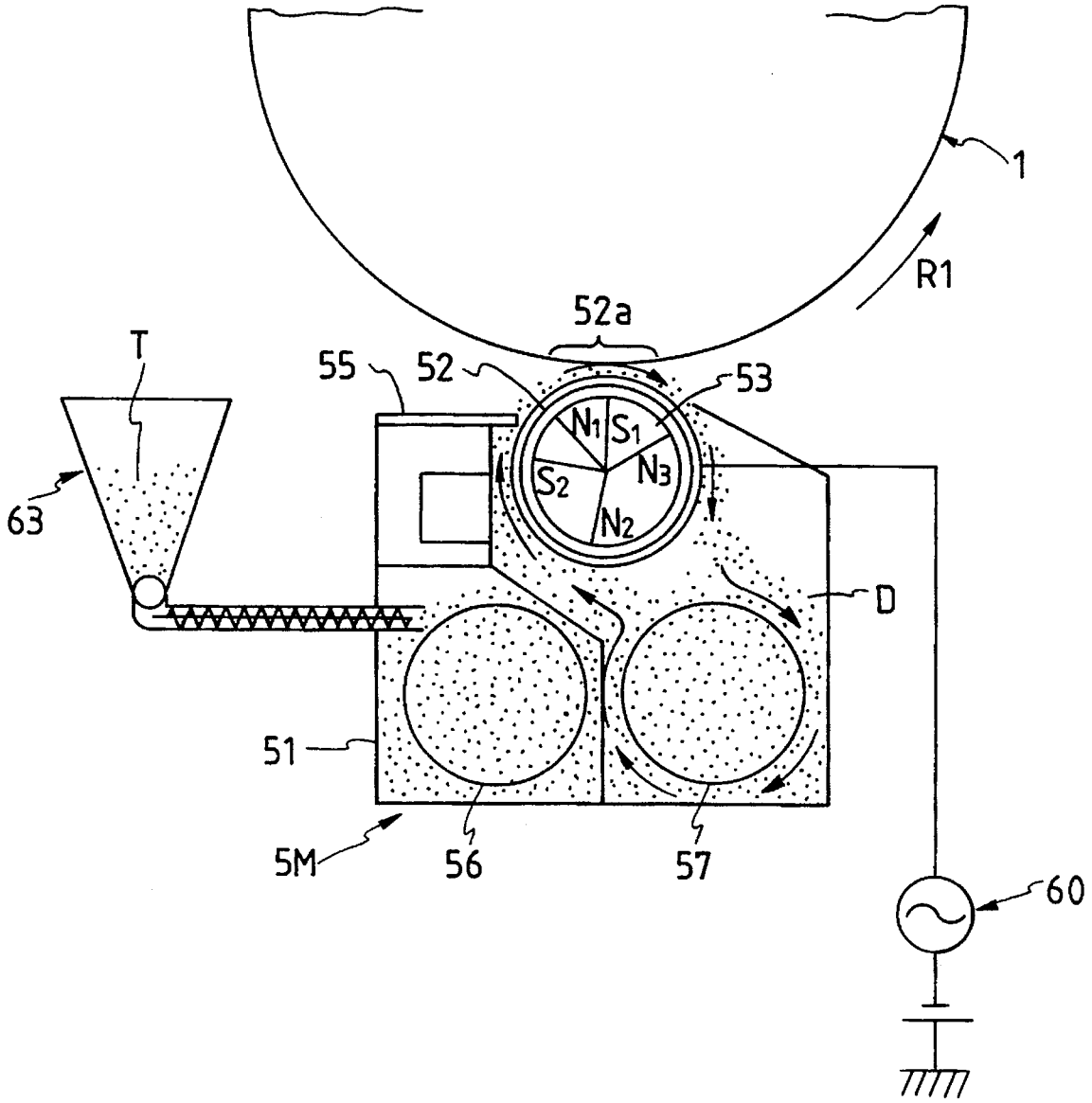
FIG. 2 is a cross-sectional view of a developing device shown in FIG. 1.

The image development is carried out by four developing devices 5Y, 5C, 5M, 5BK positioned around the above-explained photosensitive drum 1. The development employs high-resistance magnetic powder as a carrier, and consists of maintaining developer, which is a mixture of toner and carrier, as a thin layer on a developing sleeve and applying a bias electric field between the photosensitive drum 1 and the developing sleeve. As the four developing devices 5Y, 5C, 5M, 5BK are similar in structure, the magenta developing device 5M is illustrated as an example in detail in FIG. 2.

The two-component developer D employed in the developing device 5M is a mixture of magnetic carrier C of an average particle size of 10 μm and colored powder (toner) T of an average particle size of several microns in a certain proportion. The developer D is coated, by a thickness defining member 55, as a thin layer of 20–100 $mg/cm^2$, on a non-magnetic developing sleeve 52 provided therein with fixed magnetic field generating means 53. The developer D in such thin layer is supported on the surface of the developing sleeve 52 and is transported to a developing position 52*a* opposed to the photosensitive drum bearing the electrostatic latent image thereon.

An AC bias voltage 60, superposed with a DC voltage, is applied to the developing sleeve 52, thereby generating an AC electric field at the developing position 52*a*, whereby the toner T in the developer D on the developing sleeve 52 moves to the surface of the photosensitive drum 1 and adheres to the electrostatic latent image, thereby forming a toner image. The bias voltage, though dependent on the process speed, generally has a peak-to-peak voltage Vpp of 0.5 to 3.0 kV and a frequency Vf of 0.5 to 10 kHz. In the development process, the toner T is charged negatively by the defining action of the thickness defining member 55 on the developer D and by friction with the carrier C. The polarity of the toner T is the same as that of the photosensitive drum 1 charged by the primary charger 2. The mixing proportion of the magnetic carrier C and the toner T is detected by a toner concentration sensor (not shown), and is maintained at a specified toner concentration by the replenishment of toner T from a toner hopper 63 into a developing container 51. The replenished toner T is mixed with the carrier C by agitation means 56, 57 such as a screw, and is then supplied to the developing sleeve 52.

The above-explained developing method employed in this embodiment is stable and excellent in image quality, in comparison with the conventional two-component magnetic brush development process.

Figure 3:
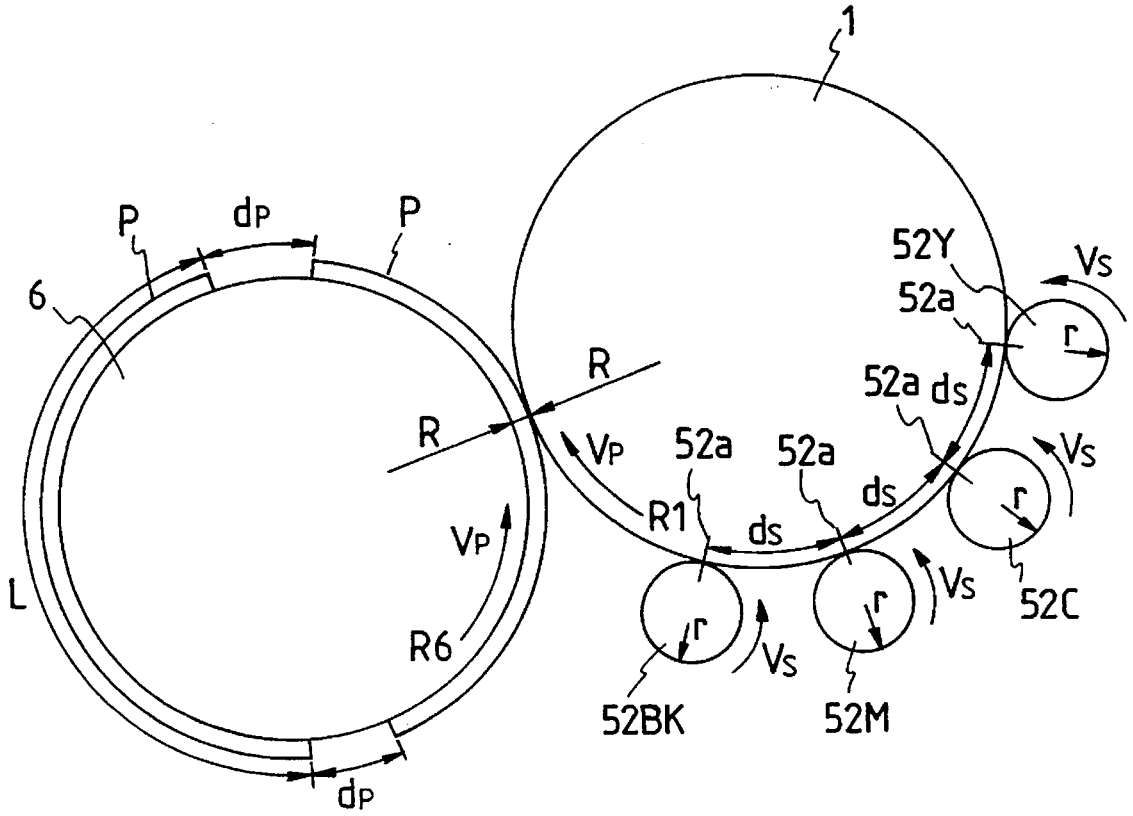
FIG. 3 is a schematic view showing the relationship among a photosensitive drum, a recording material bearing member and a developing sleeve shown in FIG. 1.
Figure 4:
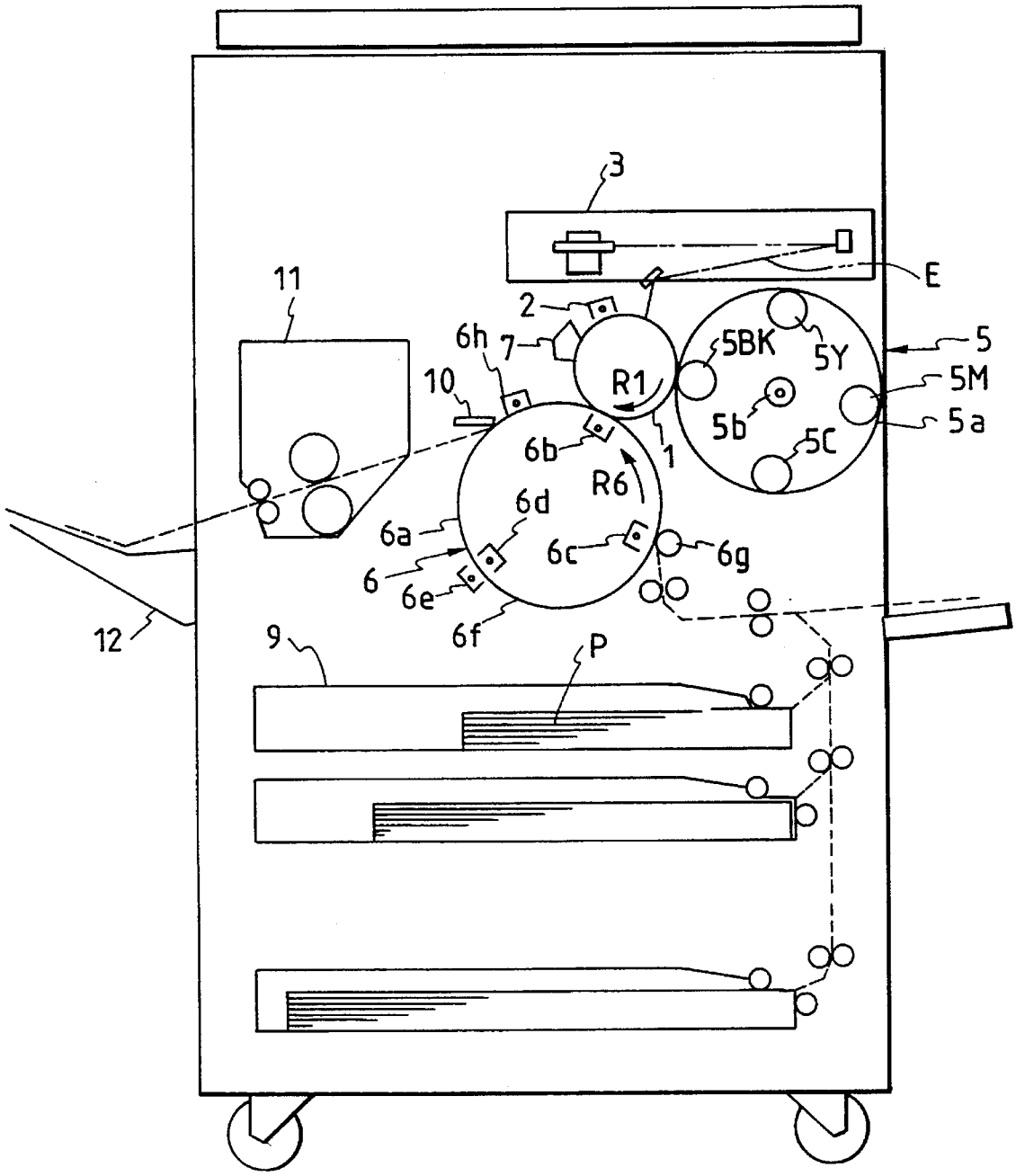
FIG. 4 is a longitudinal cross-sectional view of a conventional image forming apparatus.

The above-explained magenta developing device 5M and other yellow, cyan and black developing devices 5Y, 5C, 5BK are positioned along the surface of the photosensitive drum 1, as shown in FIG. 3 (in which the developing sleeves 52Y, 52C, 52M, 52BK alone of these developing devices are illustrated), and the recording material support member 6 is maintained in contact at the downstream side, in the rotating direction R1 of the photosensitive drum 1, of the developing sleeve 52BK positioned at the most downstream side of the above-mentioned developing devices.

The present embodiment is featured in preventing the loss in image quality and increasing the copy speed by selecting the radii, peripheral speeds and positions of the photosensitive drum 1, the recording material support member 6 and the developing sleeves 52Y, 52C, 52M, 52BK in the following manner.

The recording material support member 6 has a radius R and a peripheral speed Vp (equal to the process speed), and its peripheral length A ($=2\pi R$) is selected so as to support two recording materials P of a length L in the transport direction. Thus, when it supports thereon two recording materials P of the length L, the gap $d_p$ of the two recording materials P is represented by $d_p=(2\pi R-2L)/2$. If the support member 6 can support two letter-sized recording materials P with the shorter side thereof directed along then the transport direction, the above-mentioned length L becomes 216 mm, and, if the support member 6 has a radius R=180 mm, then the gap $d_p$ of the recording materials P becomes 66.7 mm according to the above-mentioned equation.

Then the peripheral length of the photosensitive drum 1 is selected equal to the peripheral length A of the support member 6. Stated differently, both have the same radius R, so they have the same peripheral length. Such condition is selected for preventing loss in image quality. As the length L, in the transport direction, of the recording material P supported on the support member 6 is shorter, even in the longest case, than the peripheral length A of the support member 6 (L<A), the toner image can be sufficiently transferred on the entire area of the recording material P by a turn of the photosensitive drum 1, of which the peripheral length is the same as that of the support member 6. Thus, the image quality is not affected undesirably by the transfer memory effect, by the application, at the toner image transfer, of the bias voltage of a polarity (positive) opposite to the charging polarity (negative) of the photosensitive drum 1. In the conventional case in which, for example, the radius of the photosensitive drum 1 is selected as a half of that of the recording material support member 6 thereby transferring the toner image onto the recording material P on the support member 6 by two turns of the photosensitive drum 1, the toner image transfer in the first turn is achieved satisfactorily, but that in the second turn the image transfer tends to result in a higher image density because of the transfer bias of the first turn remaining as the transfer memory effect on the photosensitive drum 1. In the present embodiment, such loss in image quality is presented by selecting the same radius for the photosensitive drum 1 and the recording material support member 6.

Also a loss in copy speed is prevented by maintaining a specified distance between the neighboring developing sleeves. Four developing devices 5Y, 5C, 5M, 5BK are to be activated completely independently, in such a manner that the functions thereof do not mutually overlap, because, if two or more developing devices are activated at the same time, then there will be required a large load for driving the developing sleeves, resulting in a variation in the rotating speed thereof or vibration given to the photosensitive drum 1, eventually deteriorating the image quality.

In the case of image formation with two recording materials p supported on the support member 6, the gap $d_p$ of the two recording materials P is, as already explained before:

$$d_p=(2\pi R-2L)/2.$$

In order to effect switching from one developing sleeve to another within said gap $d_p$, without simultaneous activation of two developing sleeves, the gap $d_p$ of the recording materials P has to be selected at least longer than the distance $d_s$ of the neighboring developing sleeves. The above-mentioned distance $d_s$ of the neighboring developing sleeves means the length between the closest positions measured along the periphery of the photosensitive drum, wherein the closest position means a position on the photosensitive drum where the surface of each developing sleeve comes closest in the developing position 52*a*.

When the four developing sleeves 52Y, 52C, 52M, 52BK are provided along the rotating direction of the photosensitive drum 1 in positions close to the surface thereof, the distance $d_s$ of the neighboring developing sleeves is at least 2r, wherein r is the radius of the developing sleeves.

On the other hand, in order to stably develop the electrostatic latent image on the photosensitive drum 1, the toner T in the developer D maintained as a thin layer on the developing sleeve has to be provided with a sufficient charge, and, for this purpose, the developer D should have been subjected to certain agitation at the start of image development. The toner T can be sufficiently charged by magnetic agitation in the rotation of about a half turn, or of $\pi r$, of the developing sleeve, wherein r is the radius thereof, though the level of charging is somewhat influenced by the physical properties of the toner T and the carrier C. Stated differently, the developing sleeve has to be rotated by a half turn before beginning development of the electrostatic latent image on the photosensitive drum 1.

In summary of the foregoing, it is most preferable to maintain the following relationship between the gap $d_p$ between two recording materials p on the recording material support member 6 and the distance $d_s$ between the neighboring developing sleeves, where $V_s$ is the peripheral speed of the developing sleeve:

$$d_p=(2\pi R-2L)/2>d_s\geqq 2r+(V_p/V_s)\pi r$$

By selecting the various parameters so as to satisfy the above-mentioned relation, it is rendered possible, even in the case of supporting two recording materials P on the support member 6 and switching the developing sleeve to another, to terminate the development by the first developing sleeve and to start satisfactory development with the second developing sleeve before a surface portion of the photosensitive drum 1 corresponding to the gap between the two recording materials P on the support member 6 moves from the position of the first develoing sleeve to that of the second. In this manner, unnecessary rotation of the photosensitive drum 1 and the support member 6, required in the conventional technology, is no longer required, and the copying speed can therefore be increased.

In the present embodiment, the radius of the photosensitive drum 1 need not necessarily be selected the same as that of the recording material support member 6, if the copying speed alone is considered. For this consideration, the relation between the gap $d_p$ between two recording materials P supported on the support member 6 and the distance $d_s$ between the neighboring developing sleeves is relevant but the radius of the photosensitive drum 1 is irrelevant. For example, even in the case where the radius of the photosensitive drum 1 is half of that of the recording material support member 6, the present embodiment is still applicable for increasing the copying speed.

[Embodiment 2]

The configuration was the same as that in embodiment 1 except that the electrophotographic photosensitive member contained, in the surface protective layer thereof, 1 part by weight of tin oxide powder (average primary particle size: 0.3 μm).

[Embodiment 3]

The configuration was the same as that in embodiment 1 except that the acrylic monomer resin in the surface protective layer of the electrophotographic photosensitive member consisted of epoxy resin, contained in an amount of 10 parts by weight.

[Embodiment 4]

On an aluminum cylinder, the conductive layer, subbing layer, charge generating layer and charge transfer layer were formed in the same manner as in embodiment 1.

Then the photosensitive member was prepared in the same manner as in embodiment 1, except that a solution, obtained by dissolving 6 parts by weight of polycarbonate resin (number-averaged molecular weight: 25,000), 3 parts by weight of the aforementioned charge transfer material, 1 part by weight of polytetrafluoroethylene (average primary particle size: 0.3 μm) in a mixture of 200 parts by weight of dichloromethane and 300 parts by weight of monochlorobenzene, was spray coated on the charge transfer layer and dried at 120° C. for 60 minutes to obtain a surface protective layer having a thickness of 5 μm.

[Embodiment 5]

The configuration was the same as that in embodiment 4, except that the photosensitive member lacked the surface protective layer and contained, in the charge transfer layer, polytetrafluoroethylene particles (average primary particle size: 0.3 μm) in an amount of 10%.

[Embodiment 6]

The configuration was the same as that in embodiment 4, except that polytetrafluoroethylene particles in the surface protective layer of the photosensitive member had an average particle size of 0.1 μm.

The above-mentioned photosensitive members have the advantages of safety and inexpensiveness, common to the organic polymer photosensitive member, and L further are featured by a low initial dark decay, a high abrasion resistance of the surface protective layer, and a limited variation in dark decay, due to the limited variation in film thickness by scraping after prolonged use, namely due to the limited variation in the capacitance. The use of such an organic photosensitive member prevents variation in the color balance of the color image, due to the influence of dark decay, when the peripheral length of the photosensitive drum is extended the same as that of the transfer drum 6*a*, thereby enabling a 1:1 ratio between the peripheral lengths of the photosensitive drum 1 and the transfer drum 6*a*.

On the other hand, a photosensitive member having the surface protective layer may be strongly influenced by the image transfer as already explained in the drawbacks of the prior art, and the present invention is effective also in advantageously utilizing the photosensitive member with a surface protective layer.

The photosensitive member may be free from the surface protective layer, and may be of the following compositions.

The photosensitive member employed in the present invention contains conductive metallic powder or fluorinated resin on the surface of the photosensitive layer. The conductive metallic powder is at least one selected from metals such as aluminum, copper, nickel or silver, and metal oxides such as zinc oxide, titanium oxide, tin oxide, antimony oxide, indium oxide, bismuth oxide, tin-doped indium oxide, antimony-doped tin oxide or zirconium oxide, and preferably has a primary particle size not exceeding 0.3 μm.

Also the fluorinated resin powder employable in the present invention is at least one selected from tetrafluoroethylene resin, trifluoroethylene resin, tetrafluoroethylene-hexafluoropropylene resin, fluorinated vinylic resin, fluorinated vinylidene resin, difluorochloroethylene resin and copolymers thereof, and is preferably of a low molecular grade with a primary particle size not exceeding 0.3 μm.

This value may seem too small since it only needs to be shorter than the wavelength of the laser beam according to the aforementioned condition, but the actual system inevitably involves a certain amount of secondary and tertiary particles, and the size of the primary particles not exceeding 0.3 μm is derived from an experiment in consideration of this fact.

The content of the conductive metallic powder dispersed in the surface layer is within a range of 5 to 90 wt.%, preferably 10 to 90 wt. %, of the solid weight thereof. A content less than 5 wt. % results in an excessively high resistance, causing an increased residual charge, while a content exceeding 90 wt. % results in an excessively low resistance for the surface layer, leading to a lowered charging ability or formation of pinholes. Also the content of the fluorinated resin powder dispersed in the surface layer is within a range of 1 to 50 wt. %, preferably 2 to 30 wt. %, of the solid weight thereof. A content less than 1 wt. % cannot provide sufficient modification of the surface layer by the fluorinated resin, while a content exceeding 50 wt. % results in a lowered optical transmittance and a lowered carrier mobility.

The binder resin to be employed for forming the surface layer can be any polymer substance with film forming property, but, in order that said resin has a certain hardness by itself and does not hinder the carrier movement, there is preferred polymethacrylate ester, polystyrene, methacrylate ester/styrene copolymer, polycarbonate, polyester or polysylfone. Also the curable resin for forming the surface layer is thermosettable resin such as polyurethane resin, epoxy resin, melamine resin or guanamine resin, or photocurable resin represented by polyacrylates.

In the preparation of the electrophotographic photosensitive member to be employed in the present invention, the conductive substrate can be composed of a cylindrical member or a sheet, having a conductive layer, composed of conductive particles dispersed in suitable binder resin, on a substrate such as a metal for example aluminum or stainless steel, or paper or a plastic material. However, such conductive layer may be dispensed with if the substrate itself is conductive.

On such a conductive substrate, there may be provided a subbing (adhesion) layer having the functions of barrier and subbing.

The above-mentioned subbing layer has the functions the improvement of adhesion and/or coating property of the photosensitive layer, protecting the conductive substrate, covering defects thereof, improving charge injection from the conductive substrate, and/or protecting the photosensitive layer against electrical destruction. The subbing layer can be composed, for example, of polyvinyl alcohol, poly-N-vinylimidazole, polyethyleneoxide, ethyl cellulose, methyl cellulose, ethylene-acrylic acid copolymer, casein, polyamide copoymerized nylon, glue or gelatin. Such material can be coated on the substrate by dissolving it in a suitable solvent, with a thickness within a range of about 0.2 to 2 μm. The charge generating material can be composed of a cyanine dye, an azulene dye, a squarilium dye, a pyrilium dye, a thiopyrilium dye, a phthalocyanine pigment, an antanthrone pigment, a dibenzpyrenequinone pigment, a pyranthrone pigment, a monoazo pigment, a disazo pigment, an indigo pigment, a quinachridone pigment, an asymmetric quinocyanine or a quinocyanine. The charge transfer material can be pyrene; N-ethylcarbazole; N-isopropylcarbazole; N-methyl-N-phenylhydrazino-3-methylidene-9-ethylcarbazole; N,N-diphenylhydrazino-3-methylidene-9-ethylcarbazole; N,N-diphenylhydrazino-3-methylidene-10-ethylphenothiazine; N,N-diphenylhydrazino-3-methylidene-10-ethylphenoxadine; a hydrazone such as p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone or p-diethylbenzaldehyde-3-methylbenzthiazolinone-2-hydrazone; 2,5-bis(p-diethylaminophenyl)-1,3,4-oxadiazole; a pyrazoline such as 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl)pyrazoline, 1-[pylidyl(2)]-3-(p-diethylaminostyryl)-5-(p-diethylaminophenyl)pyrazoline, 1-[6-methoxypyridyl(2)]3-3-(p-diethylaminostyryl)-5-(p-diethylaminophenyl)pyrazoline, 1-[pyridyl(3)]-3-(p-diethylaminostyryl)-5-(p-diethylaminophenyl)pyrazoline, 1-[pyridyl(2)]-3-(p-diethylaminostyryl)- 5-(p-diethylaminophenyl)pyrazoline, 1-[pyridyl(2)]-3-(p-diethylaminostyryl)-4-methyl-5-(p-diethylaminophenyl)-pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline or spiropyrazoline; and oxazole such as 2-(p-diethylaminostyryl)-6-diethylaminobenzoxazole or 2-(p-diethylaminophenyl)-4-(p-dimethylaminophenyl)-5-(2-chlorophenyl)oxazole; a thiazole such as 2-(p-diethylaminostyryl)-6-diethylaminobenzothiazole; a triarylmethane such as bis(4-diethylamino-2-methylphenyl)phenylmethane; a polyarylalkane such as 1,1-bis(4-N,N-dimethylamino-2-methylphenyl)heptane or 1,1,2,2-tetraquis(4-N,N-dimethylamino-2-methylphenyl)-ethane; or a stylbene such as 5-(4-diphenylaminobenzylidene)-5H-dibenzo[a,b]cycloheptene or 1,2-benzo-3-(d-phenylstyryl)-9-n-butylcarbazole.

In the following there will be explained the method of preparation of the electrophotographic photosensitive member to be employed in the present invention, in the case of a function-separated photosensitive member in which a charge transfer layer is laminated on a charge generating layer.

The above-mentioned charge generating substance is dispersed, together with binder resin of an amount of 0.3 to 10 times and solvent, for example with a homogenizer, ultrasonic dispersion, a ball mill, a vibrated ball mill, a sand mill or a roller mill, and the obtained dispersion is coated on the substrate bearing thereon the aforementioned subbing layer and dried to obtain a coated film of a thickness of about 0.1 to 1 μm.

In the present example, as the charge transfer layer constitutes the surface layer, the fluorinated resin powder is dispersed therein. Binder resin and fluorinated resin powder are dispersed in solvent for example by a homogenizer ultrasonic dispersion, a sand mill or a roller mill, and the solution of the charge transfer substance and the binder resin is added thereto to obtain coating liquid for the charge transfer layer. The mixing ratio of the charge transfer substance and the binder resin is within a range from 2:1 to 1:4.

The solvent can be an aromatic hydrocarbon such as toluene or xylene; or a chlorinated hydrocarbon such as dichloromethane, chlorobenzene, chloroform or carbon tetrachloride. The above-mentioned coating liquid can be coated, for example, by dip coating, spray coating, spin coating, bead coating, blade coating or curtain coating, and dried under air blowing or in still air within a temperature range from 10° C. to 200° C., preferably 20° C. to 150° C., for a period of 5 minutes to 5 hours, preferably 10 minutes to 2 hours. The charge transfer layer thus formed has a thickness of about 10 to 30 μm.

In the case of a photosensitive member in which the charge generating layer is provided on the charge transfer layer, the fluorinated resin powder is dispersed in the charge generating layer constituting the surface layer. The dispersion for forming such charge generating layer can be prepared by adding and mixing dispersion, obtained dispersing the fluorinated resin powder in the binder resin employed for the charge generating layer, with the dispersion of the charge generating substance prepared in the aforementioned manner, and the photosensitive member of the present invention can be prepared by coating the above-mentioned dispersion on the charge transfer layer.

When the photosensitive layer has a protective layer, the fluorinated resin powder is contained in such protective layer constituting the surface layer. This protective layer can be obtained by coating dispersion, obtained by dispersing the fluorinated resin powder in the aforementioned resin for constituting the protective layer, on the photosensitive layer.

As explained in the foregoing, the present invention enables, by maintaining a specified relationship between the gap of plural recording materials on the transfer member and the distance of developing rollers of the developing device, opposed to the photosensitive member, to exchange the developing rollers within the passing time of the gap between the recording materials, thereby dispensing with the unnecessary rotation of the photosensitive member, required for the exchange of the develoing rollers, and thus increasing the image forming speed. Also the present invention can eliminate any difference in image density, resulting from the transfer memory effect in certain kinds of photosensitive members, thereby preventing deterioration in image quality, by selecting the radius of the photosensitive member equal to that of the transer member.

The embodiments of the present invention employ a configuration in which a recording material is supported on a transfer member and color toners are superposed on said recording material, but said transfer member may naturally be replaced by a conventional intermediate transfer member as disclosed in the Japanese Patent Publication Nos. 5-87828 and 59-24418.

In such a configuration, the color toner images directly formed on the transfer drum 6a are collectively transferred onto the recording material.

What is claimed is:

1. A color image forming apparatus for forming a color image by transferring color toners onto a transfer material, comprising:

an endless loop electrophotographic photosensitive member having a loop length greater than a maximum length of images to be formed and transferred onto a transfer material;

color latent image forming means provided with optical means for projecting optical information corresponding to color images, for forming electrostatic latent images respectively corresponding to color images, on said photosensitive member;

plural color development means provided along the moving direction of said photosensitive member, opposed to said photosensitive member, and adapted to develop latent images formed on said photosensitive member with color toners supplied thereto by developing rollers, thereby forming color toner images; and an endless loop transfer member adapted to effect an endless movement in synchronization with the electrophotographic photosensitive member and having a loop length A, in the moving direction of the photosensitive member, capable of simultaneously supporting two images of the maximum length L, and adapted to receive transfer of color toner images formed on said photosensitive member, in succession at a transfer position of said transfer member;

wherein a relation:

$$d_p > d_s \geqq 2r + (V_p/V_s)\pi r$$

is substantially satisfied, where A is the loop length of said transfer member in said endless moving direction, R is the radius and $V_p$ is the peripheral speed of the transfer member when it is converted as circular, r is the radius and $V_s$ is the peripheral speed of the developing rollers of said development means, $d_p$ is a distance between two successive images on said transfer member at a position corresponding to a time during which said development means changes from one developing roller having one color toner to another developing roller having another color toner, and $d_s$ is the distance between the developing rollers along the moving direction of the photosensitive member.

2. An apparatus according to claim 1, wherein $$d_p > d_s \geqq 2r + (V_p/V_s)\pi r.$$

3. An apparatus according to claim 1, wherein a sheet-shaped transfer material is supplied from supply means and is supported on said transfer member, and the color toner images are transferred from the photosensitive member in succession onto said transfer material.

4. An apparatus according to claim 1, wherein color toner images are transferred in succession from the photosensitive member directly onto said transfer member, and a completed color toner image formed on said transfer member is collectively transferred onto the transfer material.

5. An apparatus according to claim 1, wherein said optical information projecting means is a digital optical system.

6. An apparatus according to claim 1, wherein said photosensitive member and said transfer member have a same length in the moving direction thereof.

7. An apparatus according to claim 6, wherein said photosensitive member has a photosensitive layer composed of organic polymer.

8. A color image forming apparatus according to claim 1, wherein $d_p$ at a position where the developing device is exchanged is larger than $(2\pi R-2L)/2$.

9. A color forming apparatus for forming a color image by transferring color toners onto a transfer material, comprising:

a rotating electrophotographic photosensitive drum having a peripheral length greater than a maximum length L of images to be formed on a transfer drum;

a color latent image forming device provided with a charge device and an optical device for projecting optical information corresponding to color images, for forming electrostatic latent images respectively corresponding to color images, on said photosensitive drum;

plural color developing devices provided along the rotating direction of said photosensitive drum and opposed to said photosensitive drum, and adapted to develop latent images formed on said photosensitive member with color toners supplied thereto by developing rollers, thereby forming color toner images; and a transfer drum rotating in synchronization with the electrophotographic photosensitive drum and provided with a peripheral length A, in the rotating direction of the photosensitive drum, capable of simultaneously supporting two images of the maximum length L, and adapted to receive transfer of color toner images formed on said photosensitive drum, in succession at a transfer position of said transfer drum;

wherein a relation:

$$d_p > d_s \geqq 2r+(V_p/V_s)\pi r$$

is substantially satisfied, where A is the peripheral length of said transfer drum in said rotating direction, R is the radius and $V_p$ is the peripheral speed of said transfer drum, r is the radius and $V_s$ is the peripheral speed of the developing rollers of said development devices, $d_p$ is a distance between two successive images on said transfer drum at a position corresponding to a time during which said developing devices change from one developing roller having one color toner to another developing device having another color toner, and $d_s$ is the distance between the developing rollers along the rotating direction of the photosensitive drum.

10. An apparatus according to claim 9, wherein $$d_p > d_s \geqq 2r+(V_p/V_s)\pi r.$$

11. An apparatus according to claim 9, wherein a sheet-shaped transfer material is supplied from supply means and is supported on said transfer drum, and the color toner images are transferred from the photosensitive drum in succession onto said transfer material.

12. An apparatus according to claim 9, wherein color toner images are transferred in succession from the photosensitive drum directly onto said transfer drum, and a completed color toner image formed on said transfer drum is collectively transferred onto the transfer material.

13. An apparatus according to claim 9, wherein said optical information projecting means is a digital optical system.

14. An apparatus according to claim 9, wherein said photosensitive drum and said transfer drum have a same length in the rotating direction thereof.

15. An apparatus according to claim 14, wherein said photosensitive drum has a photosensitive layer composed of organic polymer.

* * * * *

UNITED STATES PATENT AND TRADEMARK OFFICE

CERTIFICATE OF CORRECTION

PATENT NO. : 5,589,926 Page 1 of 3

DATED : December 31, 1996

INVENTOR(S) : YOSHIHIRO MURASAWA, ET AL.

It is certified that error appears in the above-indentified patent and that said Letters Patent is hereby corrected as shown below:

COLUMN 2

Line 24, "case" should read --the case--.

COLUMN 4

Line 13, "etc." should read --etc.,--.

COLUMN 5

Line 23, "case" should read --the case--.

COLUMN 6

Line 6, "damage" should read --damage,--.

UNITED STATES PATENT AND TRADEMARK OFFICE

CERTIFICATE OF CORRECTION

PATENT NO. : 5,589,926 Page 2 of 3

DATED : December 31, 1996

INVENTOR(S) : YOSHIHIRO MURASAWA, ET AL.

It is certified that error appears in the above-indentified patent and that said Letters Patent is hereby corrected as shown below:

COLUMN 7

Line 25, "surfacial" should read --surface--.

COLUMN 8

Line 32, "then" should be deleted.
Line 33, "direction," should read --direction, then--.
Line 63, "presented" should read --prevented--.

COLUMN 9

Line 9, "p" should read --P--.
Line 46, "p" should read --P--.
Line 63, "develoing" should read --developing--.

COLUMN 10

Line 53, "L" should be deleted.

COLUMN 11

Line 50, "sylfone." should read --sulfone.--.
Line 66, "functions the" should read --functions of--.
Line 67, "adhesion" should read --the adhesion--.

UNITED STATES PATENT AND TRADEMARK OFFICE

CERTIFICATE OF CORRECTION

PATENT NO. : 5,589,926 Page 3 of 3

DATED : December 31, 1996

INVENTOR(S) : YOSHIHIRO MURASAWA, ET AL.

It is certified that error appears in the above-indentified patent and that said Letters Patent is hereby corrected as shown below:

COLUMN 12

Line 14, "antanthrone" should read --anthanthrone--.
Line 16, "quinachridone" should read --quinacridone--.
Line 53, "tetraquis" should read --tetrakis--.
Line 54, "stylbene" should read --stilbene--.

COLUMN 13

Line 30, "obtained" should read --obtained by--.
Line 57, "transer" should read --transfer--.

COLUMN 15

Line 4, "color forming" should read --color image forming--.

COLUMN 16

Line 7, "device" should read --roller--.

Signed and Sealed this

Thirtieth Day of September, 1997

Bruce Lehman

*Attest:*

BRUCE LEHMAN

*Attesting Officer*

*Commissioner of Patents and Trademarks*